US005402737A

United States Patent [19]

Kanazawa

[11] Patent Number: 5,402,737

[45] Date of Patent: Apr. 4, 1995

[54] SUPPORTING PLATFORM

[76] Inventor: Yukio Kanazawa, 880, Sekishi-cho, Hamamatsu-shi, Shizuoka, 431-31, Japan

[21] Appl. No.: 29,606

[22] Filed: Mar. 11, 1993

[30] Foreign Application Priority Data

Mar. 13, 1992 [JP] Japan ..... 4-055347
Jul. 28, 1992 [JP] Japan ..... 4-201309

[51] Int. Cl.[6] ..... A47B 9/00
[52] U.S. Cl. ..... 108/147; 74/521
[58] Field of Search ..... 108/145, 147; 74/519, 74/520, 521; 312/334.3

[56] References Cited

U.S. PATENT DOCUMENTS 746,210 12/1903 Waite ..... 74/521

FOREIGN PATENT DOCUMENTS 1288131 4/1962 France ..... 108/145

*Primary Examiner*—Peter R. Brown
*Assistant Examiner*—Gerald Anderson
*Attorney, Agent, or Firm*—Oblon, Spivak, McClelland, Maier, & Neustadt

[57] ABSTRACT

A supporting platform with a tough structure has a height which can be optionally adjusted. In the present invention, since the intermediate section which links the base section to be placed on the floor with a platform on which a person or object is placed comprises expandable and contractable links, a gear mechanism for regulating the movements of these links and a gear stop mechanism for regulating the gear, it is possible to provide a supporting platform of extremely high durability.

6 Claims, 6 Drawing Sheets

SUPPORTING PLATFORM

BACKGROUND OF THE INVENTION

1. Field of the Invention

The present invention relates to an improvement of a supporting platform on which a person or a thing is to be placed, such as a chair, table, or working stand.

2. Description of the Prior Art

Among such supporting stands as a chair whose height is adjustable, as described above, there are many types which are provided with a slide section, by which the height in the vertical direction is variable, at the column between the base of a chair and platform thereof.

In the case of a height adjustable chair having such a slide section as described above, since the slide section is made of friction components, there is a shortcoming by which the wearing thereof proceeds to cause the service life thereof to be comparatively shortened, due to the application of a person's weight.

SUMMARY OF THE INVENTION

It is therefore an object of the present invention to provide a tough supporting platform whose height is adjustable.

In order to achieve the object, the gist of the first means which is employed by the present invention is that a supporting platform having a base section to be placed on the floor, a platform to be arranged on the base section for the purpose of placing an object thereon, and an intermediate section which links the above base section with the above platform, is characterized in that the above intermediate section comprises a pair of gears rotatably installed so that its rotary shaft can become parallel to the lower side of the platform, a gear stop mechanism which causes the rotation of the above pair of gears to stop at an optional position, and a link mechanism, the upper end of which is linked to the above pair of gears and the lower end of which is linked to the fulcrum shaft on the above base section, and which can stop the expansion and contraction in line with the stopping of the pair of gears with an operation of the gear stop mechanism.

Still in order to accomplish the above object, the gist of the second means which is employed by the present invention is that a supporting platform having a base section to be placed on the floor, a platform to be arranged on the base section for the purpose of placing an object thereon, and an intermediate section which links the above base section with the above platform, is characterized in that the above intermediate section comprises a pair of gears rotatably installed so that its rotary shaft can become parallel to the lower side of the platform, a gear stop mechanism which causes the rotation of the above pair of gears to stop at an optional position, and a plurality of link mechanisms, the upper end of which is linked to the above pair of gears and the lower end of which is linked to the fulcrum shaft on the above base section, and which can stop the expansion and contraction in line with the stopping of the pair of gears with an operation of the gear stop mechanism.

Furthermore, the gist of the third means of the present invention is that a supporting platform having a base section to be placed on the floor, a platform to be arranged on the base section for the purpose of placing an object thereon, and an intermediate section which links the above base section with the above platform, is characterized in that the above intermediate section comprises a pair of gears rotatably installed so that its rotary shaft can become parallel to the lower side of the platform, a gear stop mechanism which causes the rotation of the above pair of gears to stop at an optional position, a locking mechanism which is engaged with the gear stop mechanism and can adequately lock the gear stop mechanism, and a link mechanism, the upper end of which is linked to the above pair of gears and the lower end of which is linked to the fulcrum shaft on the above base section, and which can stop the expansion and contraction in line with the stopping of the pair of gears with an operation of the gear stop mechanism.

Still furthermore, the gist of the fourth means of the present invention is that a supporting platform having a base section to be placed on the floor, a platform to be arranged on the base section for the purpose of placing an object thereon, and an intermediate section which links the above base section with the above platform, is characterized in that the above intermediate section comprises a pair of gears rotatably installed so that its rotary shaft can become parallel to the lower side of the platform, a gear stop mechanism which causes the rotation of the above pair of gears to stop at an optional position, a locking mechanism which is engaged with the gear stop mechanism and can adequately lock the gear stop mechanism, and a plurality of link mechanisms, the upper end of which is linked to the above pair of gears and the lower end of which is linked to the fulcrum shaft on the above base section, and which can stop the expansion and contraction in line with the stopping of the pair of gears with an operation of the gear stop mechanism.

With the present invention, in the case that the gear stop mechanism is released, the pair of gears will be freely rotatable, and the link mechanism linked with the pair of gears will be able to freely expand and contract. Therefore, if the platform is vertically moved with the above gear stop mechanism released, the link mechanism expands and contracts in line therewith, and at the same time, the above pair of gears rotate. If the pair of gears stop rotating due to the action of the gear stop mechanism with the platform thus lifted to a specified height, the movement of the link mechanism also stops and it will act as a leg member at a specified height, thereby causing the platform to be supported.

With the above construction, the strength thereof can be improved by providing a plurality of the link mechanisms. Furthermore, the state in which the above link mechanism is held at a specified height of expansion and contraction is made more reliable by providing the locking mechanism which can adequately lock the gear stop mechanism.

Since the present invention is so composed as described above, it removes the need for a slide section to adjust the height of the leg member which composes a supporting platform such as a chair. It is therefore possible to provide a durable supporting platform which can be composed of only tough gears and a link mechanism and can be adjusted to an optional height.

DETAILED DESCRIPTION OF THE PREFERRED EMBODIMENTS

Figure 1:
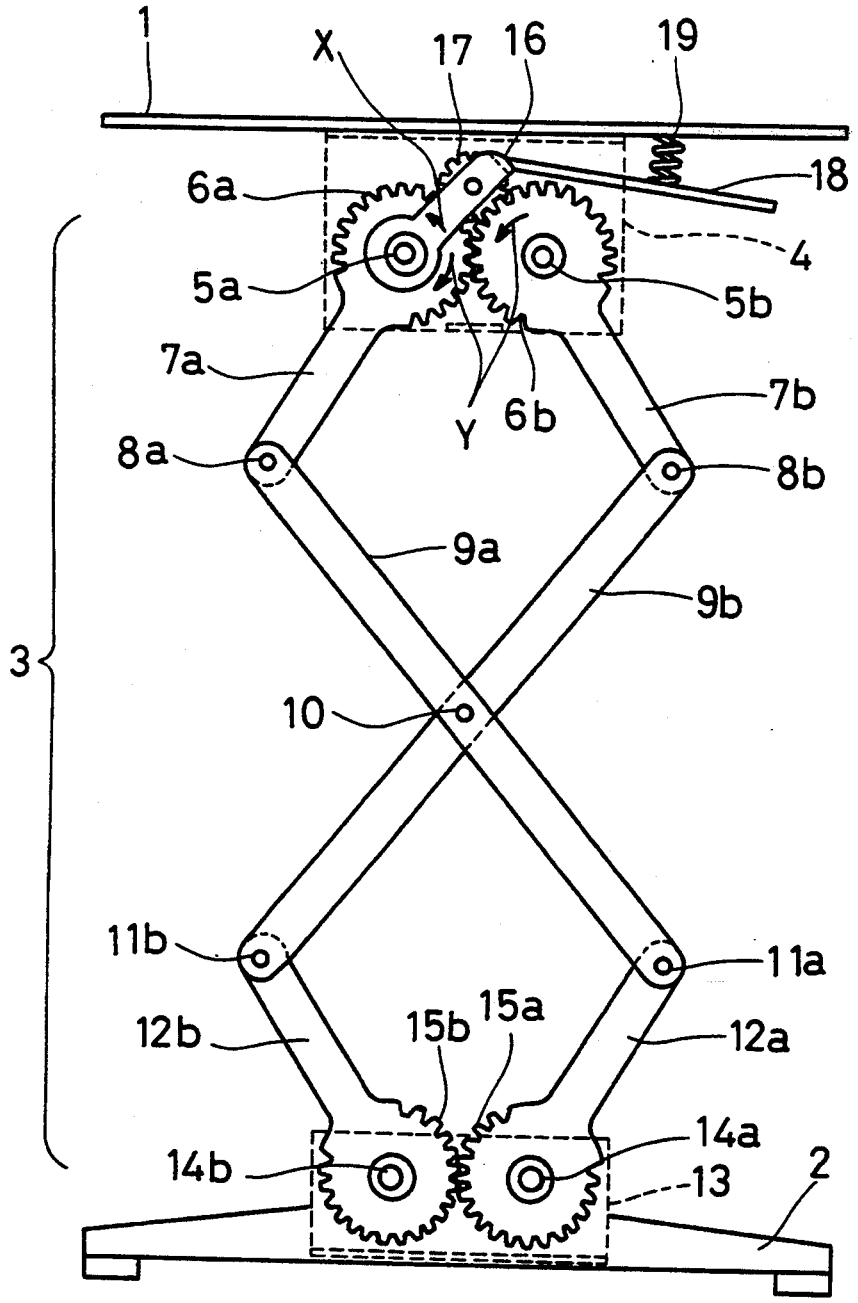
FIG. 1 is a front elevational view of a supporting platform of a preferred embodiment of the present invention.
Figure 2:
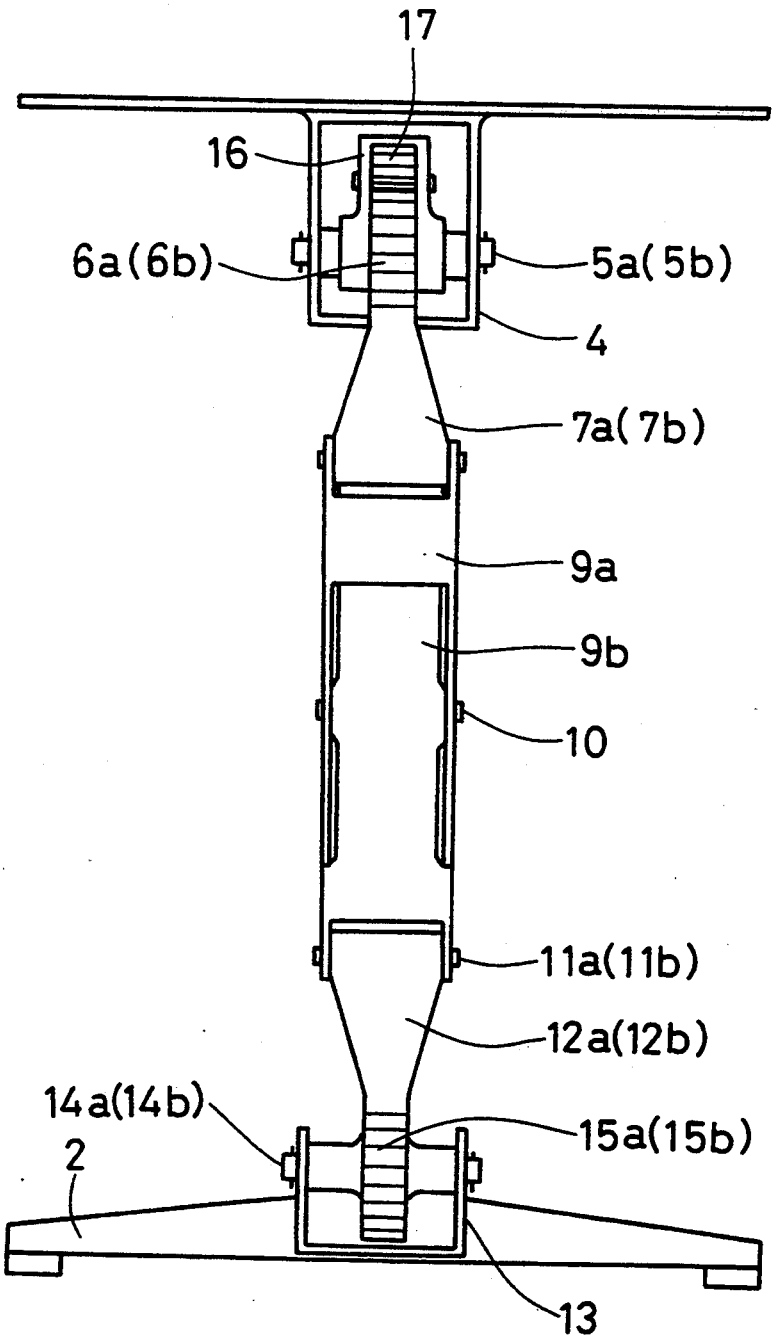
FIG. 2 is a side elevational view of a supporting platform of a preferred embodiment of the present invention.

Continuously, with reference to the drawings, a description is given of a preferred embodiment of the present invention for the purpose of understanding the invention.

This preferred embodiment is an example of a supporting platform according to the present invention, which is applied to a chair. The supporting platform comprises a platform 1 on which a person or an object is placed, a base section 2 which is placed on the floor, and an intermediate section 3 which links the platform 1 with the base section 2. The following description deals with the structure of the intermediate section 3.

An upper frame 4 of which the section is channel-shaped when viewed from the side thereof is fixed at the lower side of the platform 1 which is horizontally installed, and a pair of gears 6*a*, 6*b* are rotatably supported on parallel shafts 5*a*, 5*b* which are horizontally attached to the upper frame 4. The gears 6*a*, 6*b* are meshed with each other in the preferred embodiment, but they are not necessarily meshed with each other.

The second links 9*a*, 9*b* are rockably linked with the free end of the first links 7*a*, 7*b* integrally provided with the gears 6*a*, 6*b* by means of pins 8*a*, 8*b*. The second links 9*a*, 9*b* are linked in an X-shape by means of a central pin 10. Still furthermore, they are linked with the third links 12*a*, 12*b* by means of pins 11*a*, 11*b*.

Furthermore, The third links 12*a*, 12*b* are formed integrally with the gears 15*a*, 15*b* which are rotatably supported at horizontal parallel shafts 14*a*, 14*b*. Then, the parallel shafts 14*a*, 14*b* are supported at the lower frame 13 which is fixed at the base section 2. In this preferred embodiment, the above gears 15*a*, 15*b* are meshed with each other, but such meshing is not necessarily required. Besides, the third links 12*a*, 12*b* may be directly rotatably supported at the parallel shafts 14*a*, 14*b*, omitting the gears 15*a*, 15*b*.

Furthermore, in the case of the preferred embodiment, a lever 16 is rotatably supported at one (5*a*) of the parallel shafts 5*a*, 5*b*, and a gear 17 which can be disengageably meshed with one (6*b*) of the gears 6*a*, 6*b* is rotatably attached to the lever 16. The gear 17 is meshed with both the gears 6*a*, 6*b* in the state shown in FIG. 1, and is separated from the gear 6*b* when the lever 16 is shifted in the direction shown with the arrow X. A gripping rod 18 is provided at the free end of the lever 16, and a spring 19, which makes the lever 16 rotate in the direction along which the gears 17 and 6*b* are meshed with each other, is provided between the gripping rod 18 and the platform 1.

The first to third links 7*a*, 7*b*, 9*a*, 9*b* and 12*a*, 12*b* constitute the link mechanism of the present invention; the gears 6*a*, 6*b* constitute the gears of the present invention; and the gear 17 constitutes the gear stop mechanism of the present invention. Then, the link mechanism, gears and gear stop mechanism constitute the intermediate section 3.

Therefore, as shown in FIG. 1, even if the gears 6*a*, 6*b* are intended to rotate in the direction shown by the arrow Y due to a downward load applied to the platform 1 under the state in which the gear 17 is meshed with the gears 6*a*, 6*b*, they cannot rotate due to the engagement of the gear 17, then they are fixed under the state shown in the drawing. For this reason, the first links 7*a*, 7*b* which are integral with the gears 6*a*, 6*b*, and further the second links 9*a*, 9*b* and the third links 12*a*, 12*b* which are linked with the first links 7*a*, 7*b* are accordingly fixed. Then, the link mechanism comprised of these first to third links will act as a leg member, thereby causing a load such as a person etc. which is placed on the platform 1, to be supported.

Figure 3:
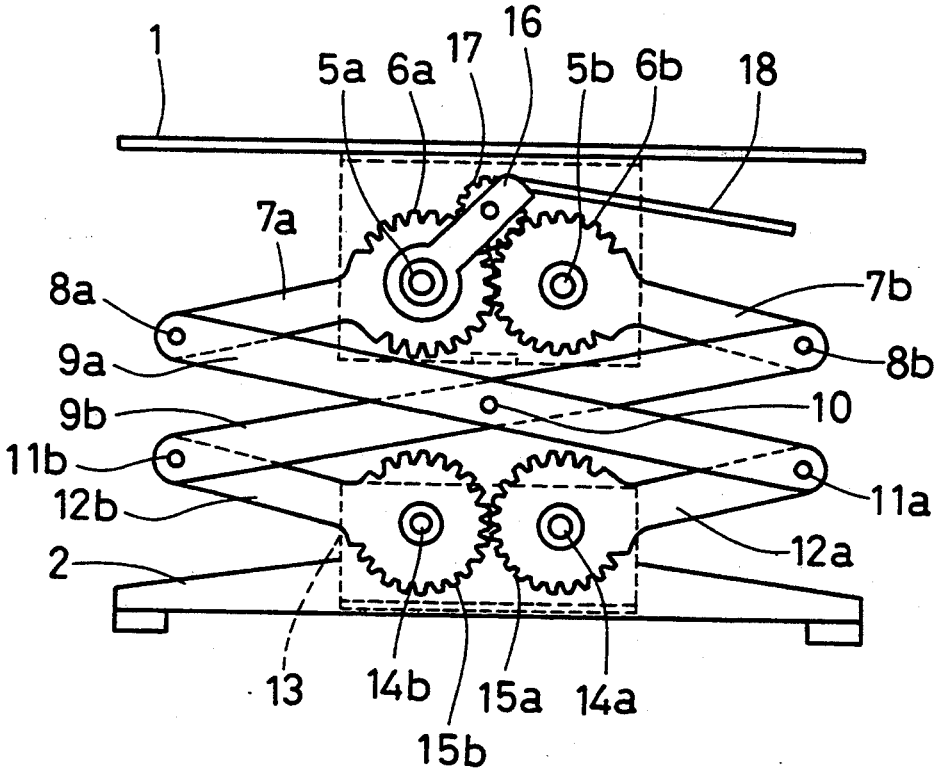
FIG. 3 is a front elevational view showing a state in which the link mechanism is contracted.

Next, if the gripping rod 18 is lifted against the spring 19, the gear 17 is separated from the gear 6*b* to cause the gears 6*a*, 6*b* to be freely rotatable. Therefore, if the platform 1 is held by a hand and is vertically moved with the gripping rod 18 lifted, the first to third links can freely expand and contract, and the gears 6*a*, 6*b* can freely rotate. FIG. 3 shows the state in which the gear 17 is released as described above, the platform 1 is moved to the lowest position and another hand is released from the gripping rod 18, that is, the state in which the intermediate section 3 is made shortest.

Accordingly, if the gripping rod 18 is released in the state in which the platform 1 is lifted to an optional height as described above, the gear 17 is meshed with both the gears 6*a*, 6*b*, thereby causing their movement to be stopped and the platform 1 to be supported at an optional height.

Furthermore, in the preferred embodiment, as the gears 6*a*, 6*b* and the gears 15*a*, 15*b* are meshed together, the first to third links are always linearly symmetrical, centering around the perpendicular line passing through the pin 10. The movement will be stabilized. To the contrary, there occurs such a shortcoming that any one of the gears 6*a*, 6*b* or gears 15*a*, 15*b* or both are not meshed, and the link mechanism is made straight when the platform 1 is lifted to the highest position, thereby causing the intermediate section 3 to be folded and bent to the right or the left to bring the supporting platform into an unstable condition.

In the preferred embodiment, the gear 17 and lever 16 compose the gear stop mechanism which stops the rotation of the gears 6*a*, 6*b*. Such a gear stop mechanism may be of any type that is engageable with the gears 6*a*, 6*b*. Moreover, it may be composed of, for example, a ratchet or a simple wedge. If the intermediate section 3 is covered with expandable and contractable bellows, it will be a presentable and innovative supporting platform.

Subsequently, a description of another preferred embodiment of the present invention is given with reference to FIGS. 4 to 6.

In this preferred embodiment, a supporting platform according to the present invention is applied to a chair jus as well as in the first preferred embodiment thereof. The preferred embodiment comprises a platform 101 on which a person or an object is placed, a base section 102 having casters 102*a*, which is placed on the floor and is movable to a desired position, and an intermediate section 103 which links the platform 101 with the base section 102.

The following description deals with the structure of the intermediate section 103.

An upper frame 104 of which the section is channel-shaped when viewed from the side thereof is fixed on the lower side of the platform 101 which is horizontally installed, and a pair of gears 106*a*, 106*b* are unrotatably supported at the parallel shafts 105*a*, 105*b*, which are horizontally installed on the upper frame 104, by way of key members 105*c*, 105*d*. The above gears 106*a*, 106*b* are meshed with each other in the preferred embodiment, but they are not necessarily always meshed with each other.

Two sets of right and left second links 109*a*, 109*b*, 109*a*, 109*b* are rockably linked via shafts 108*a*, 108*b* with the free ends of two sets of right and left first links 107*a*, 107*b*, 107*a*, 107*b*, which are integrally installed with the above parallel shafts 105*a*, 105*b*. The second links 109*a*, 109*b*, 109*a*, 109*b* are each separately linked in an X-shape by a shaft 110 at their center, and are each separately linked via shafts 111*a*, 111*b* with two sets of right and left third links 112*a*, 112*b*, 112*a*, 112*b*.

Furthermore, the third links 112*a*, 112*b*, 112*a*, 112*b* are unrotatably attached to the parallel shafts 114*a*, 114*b* which are parallel to the base section 102. The parallel shafts 114*a*, 114*b* are rotatably supported on the base section 102. Gears 115*a*, 115*b* are arranged via key members 114*c*, 114*d* on the parallel shafts 114*a*, 114*b* so that they are not rotatable for the parallel shafts 114*a*, 114*b* but slidable in their axial direction. The gears 115*a*, 115*b* are held by the lower frame 113 whose section is channel-shaped when viewed from the side thereof.

In this preferred embodiment, the gears 115*a*, 115*b* are meshed with each other, but such a meshing is not necessarily always required. Then, the gears 115*a*, 115*b* may be omitted.

In the case of the preferred embodiment, a lever 116 is rockably supported at one (105*a*) of the parallel shafts 105*a*, 105*b*, and a gear 117, which is always engageable with one gear 116*a* and is disengageably engaged with the other gear 106*b*, is rotatably attached to the lever 116.

Figure 4:
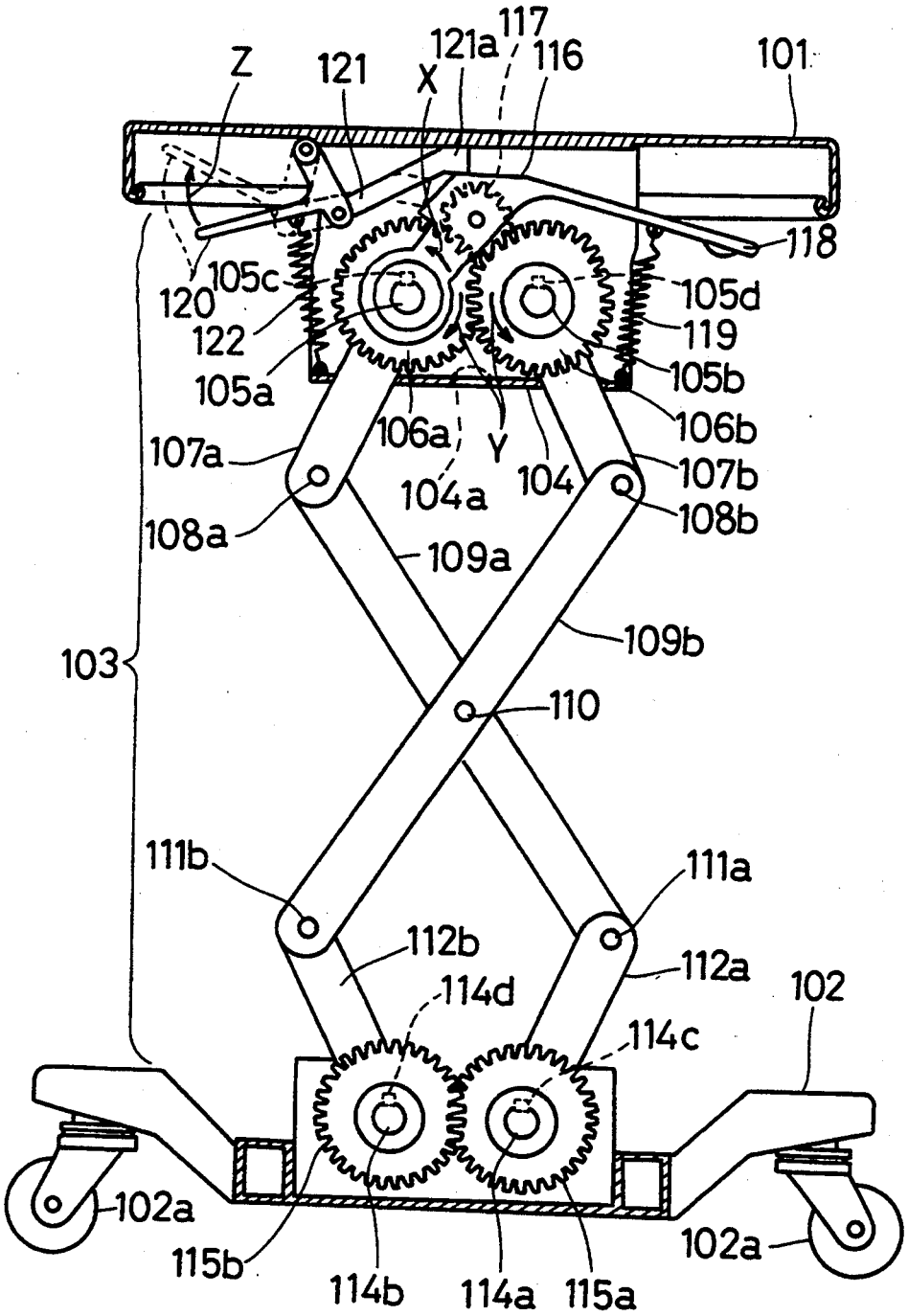
FIG. 4 is a front elevational view having a partial sectional view, of a supporting platform of another preferred embodiment of the present invention.

The gear 117 is engageable with both the gears 106*a* and 106*b* in the state shown in FIG. 4, and is separated from the gear 106*b* when the lever 116 is shifted in the direction shown by the arrow X. A gripping rod 118 is provided at the free end of the lever 116. A spring 119 which causes the lever 116 to rotate in the direction along which the gear 117 is engaged with the gear 106*b* is provided between the gripping rod 118 and the upper frame 104.

A lever 120 is rockably supported at the lower side of the platform 101, and furthermore, the lever 120 is provided with a knocking piece 121 so that the knocking piece can rockably move. Then, the free end 121*a* of the knocking piece 121 is fitted to and inserted between the lower side of the platform 101 and the upper side of the lever 116. Thereby, the rocking movement of the lever 116 can be prevented to cause unexpected drop or separation of the gear 117 from the gear 106*b* to be avoided. Thus, that contributes to improvement of the safety.

In this case, the above lever 120 is always elastically energy-charged by a spring 122 in the direction along which the free end 121*a* of the knocking piece 121 is inserted between the platform 101 and the lever 116. The free end 121*a* of the knocking piece 121 is drawn out from between the platform 101 and the lever 116 by making rocking movements of the lever 120 in the direction shown by the arrow Z against the energy-charging force. Thereby, it is possible to separate the gear 117 from the gear 106*b*.

The above first to third links 107*a*, 107*b*, 107*a*, 107*b*, 109*a*, 109*b*, 109*a*, 109*b*, 112*a*, 112*b*, 112*a*, 112*b* constitute the link mechanism of the present invention, the gears 106*a*, 106*b* constitute the gears of the present invention, the lever 116 and the gear 117 constitute the gear stop mechanism of the present invention, and the lever 120 and the knocking piece 121 constitute the locking mechanism of the present invention, respectively. The above link mechanism, gears, gear stop mechanism and locking mechanism constitute the intermediate section 103.

Therefore, even if the gears 106*a*, 106*b* are intended to rotate in the direction of the arrow Y due to a downward load applied to the platform 101, the gear 117 engages in, and cannot rotate in, the state in which both the gear 117 and the gears 106*a*, 106*b* are engaged with each other as shown in FIG. 4, and they are fixed as shown in the drawing. For this reason, the first links 107*a*, 107*b*, 107*a*, 107*b* which are integral with the gears 106*a*, 106*b*, and further the second links 109*a*, 109*b*, 109*a*, 109*b* and the third links 112*a*, 112*b*, 112*a*, 112*b* which are linked with the first links 107*a*, 107*b*, 107*a*, 107*b* are accordingly fixed. Then, the link mechanism comprised of these first to third links will act as a leg member, thereby causing a load such as a person etc. which is placed on the platform 1, to be supported.

In this case, since the locking mechanism prevents the above gear 117 from being separated from the gear 106*b*, the safety in use is remarkably high.

Next, if the lever 120 and gripping rod 118 are lifted one after another, resisting the springs 122, 119, the gear 117 can be separated from the gear 106*b* to cause the gears 106*a*, 106*b* to be freely rotatable. Therefore, if the platform 101 is held by a hand and vertically moved with the gripping rod 118 lifted (at this time, the movement of the lever 120 is regulated by the free end 121*a* of the knocking piece 121 being engaged with the lever 116), the first to third links can freely expand and contract, and the gears 106*a*, 106*b* can freely rotate. FIG. 6 shows the state in which the gear 117 is released as described above, the platform 101 is moved downwards and the hand is released from the gripping rod 118, that is, that the intermediate section 103 is made shortest.

Figure 5:
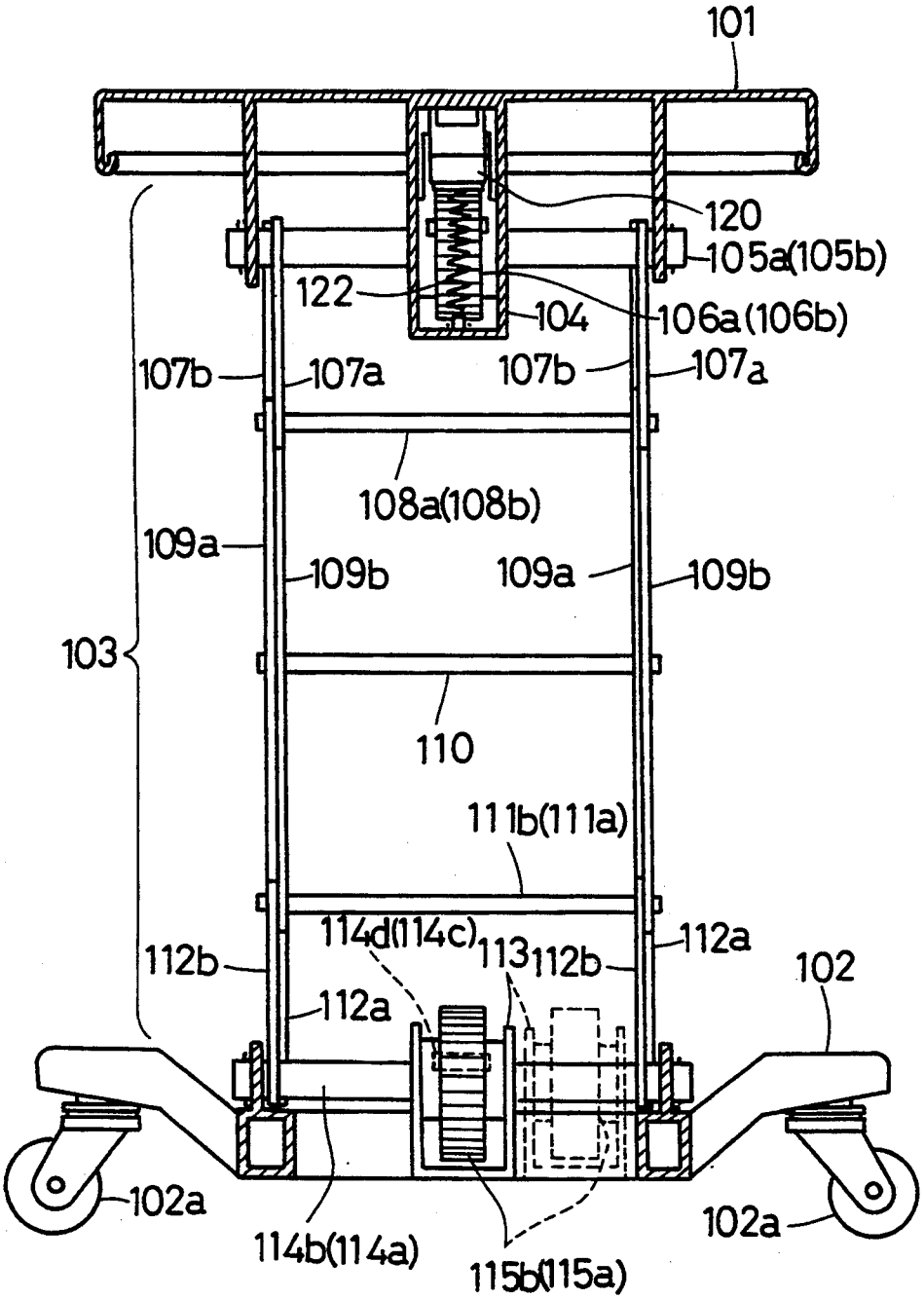
FIG. 5 is a side elevational view having a partial sectional view, of a supporting platform of another preferred embodiment of the present invention.
Figure 6:
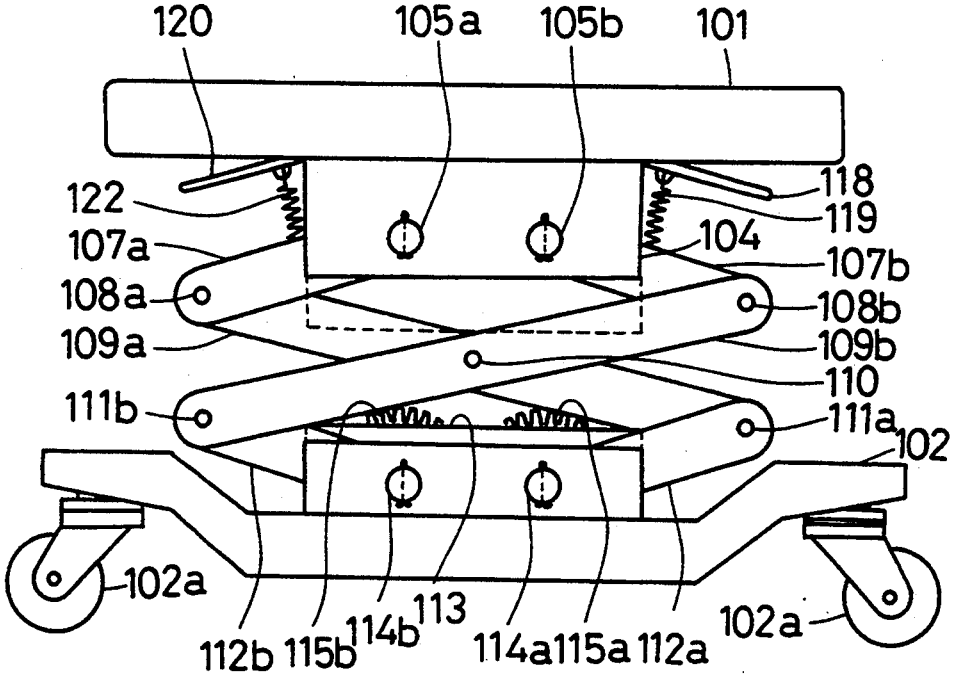
FIG. 6 is a front elevational view showing a state in which a link mechanism of a supporting platform of another preferred embodiment of the present invention is contracted.

Furthermore, as shown in FIG. 5, the compactness can be drastically achieved by making the lower frame 113 slide in either right or left direction (the right direction as shown by a dashed line in the drawing) and preventing the engagement between the gears 115*a*, 115*b* with the gears 106*a*, 106*b* and the upper frame 104. In this case, the shaft 110 can be accommodated in a concave section 104*a* formed at the lower side of the upper frame 104. (See FIG. 4).

Therefore, If the gripping rod 118 is released with the platform 101 lifted to an optional height as described above, the gear 117 is engaged with both the gears 106*a*, 106*b*, and the movement is stopped, thereby causing the platform 101 to be supported at an optional height. In this case, the free end 121*a* of the knocking piece 121 is inserted between the platform 101 and the lever 116 to cause the gear stop mechanism to be locked.

Since the base section 102 is provided with casters 102*a*, it is very easy to move.

Also, in this preferred embodiment, since both the gears 106*a*, 106*b* and gears 115*a*, 115*b* are meshed with each other, the first to third links are always linearly symmetrical, centering around the perpendicular line passing through the shaft 110, and the movement is well stabilized. To the contrary, if either one of the gears 106*a*, 106*b* or gears 115*a*, 115*b*, or both of them are not engaged, the link mechanism is made straight when the platform 101 is lifted to the highest position, thereby causing the intermediate section 103 to be folded and bent to the right or the left to bring the supporting platform into an unstable condition.

In the preferred embodiment, the gear 117 and the lever 116 compose the gear stop mechanism which stops the rotation of the gears 106*a*, 106*b*. Such a gear stop mechanism may be of any type that is engageable with the gears 106*a*, 106*b*. It is possible to compose it of, for example, a ratchet or a simple wedge. If the intermediate section 103 is covered with expandable and contractable bellows, it will be a presentable and innovative supporting platform.

In the case that the supporting platform is used where there is less possibility of danger, the structure can be simplified by omitting the above locking mechanism as an attempt to reduce the production cost.

Furthermore, it is possible to compose the supporting platform by changing the number of sets of respective links which compose the link mechanism, in order to meet the supporting weight.

What is claimed is:

1. A supporting platform comprising:

a base section which is to be placed on a floor;

a platform on which an object can be placed, said platform being arranged on said base section; and an intermediate section which links said base section to said platform;

wherein said intermediate section comprises:

a pair of gears rotatably mounted respectively on first and second rotary shafts, said first and second rotary shafts being parallel to a side of said platform which faces said first and second rotary shafts;

a link mechanism having a first end which is linked to said pair of gears, and a second end which is rotatably linked to said base section, said link mechanism expanding or contracting upon a rotation of said pair of gears; and a gear stop mechanism having an engaging gear which is movable into meshing engagement with said pair of gears for stopping the rotation of said pair of gears at an optional expanded or contracted position of said link mechanism.

2. A supporting platform comprising:

a base section which is to be placed on a floor;

a platform on which an object is to be placed, said platform being arranged on said base section; and an intermediate section which links said base section to said platform;

wherein said intermediate section comprises:

a pair of gears rotatably mounted respectively on first and second rotary shafts, said first and second rotary shafts being parallel to a side of said platform which faces said first and second rotary shafts;

a plurality of link mechanisms having first ends which are linked to said pair of gears, and second ends which are rotatably linked to said base section, said plurality of link mechanisms expanding or contracting upon a rotation of said pair of gears; and a gear stop mechanism having an engaging gear which is movable into meshing engagement with said pair of gears for stopping the rotation of said pair of gears at an optional expanded or contracted position of said link mechanisms.

3. A supporting platform comprising:

a base section which is to be placed on a floor;

a platform on which an object is to be placed, said platform being arranged on said base section; and an intermediate section which links said base section to said platform;

wherein said intermediate section comprises:

a pair of gears rotatably mounted respectively on first and second rotary shafts, said first and second rotary shafts being parallel to a side of said platform which faces said first and second rotary shafts;

a link mechanism having a first end which is linked to said pair of gears, and a second end which is rotatably linked to said base section, said link mechanism expanding or contracting upon a rotation of said pair of gears;

a gear stop mechanism gear for stopping the rotation of said pair of gears at an optional expanded or contracted position of said link mechanisms; and a locking mechanism engaged with said gear stop mechanism for locking said gear stop mechanism.

4. A supporting platform as claimed in claim 3, wherein said gear stop mechanism comprises:

an engaging gear which is movable into meshing engagement with said pair of gear for stopping the rotation of said pair of gears.

5. A supporting platform comprising:

a base section which is to be placed on a floor;

a platform on which an object is to be placed, said platform being arranged on said base section; and an intermediate section which links said base section to said platform;

wherein said intermediate section comprises:

a pair of gears rotatably mounted respectively on first and second rotary shafts, said first and second rotary shafts being parallel to a side of said platform which faces said first and second rotary shafts;

a plurality of link mechanisms having first ends which are linked to said pair of gears, and second ends which are rotatably linked to said base section, said plurality of link mechanisms expanding or contracting upon a rotation of said pair of gears;

a gear stop mechanism for stopping the rotation of said pair of gears at an optional expanded or contracted position of said plurality of link mechanisms; and a locking mechanism engaged with said gear stop mechanism for locking said gear stop mechanism.

6. A supporting platform as claimed in claim 5, wherein said gear stop mechanism comprises:

an engaging gear which is movable into meshing engagement with said pair of gears for stopping the rotation of said pair of gears.

* * * * *